US006550064B2

(12) United States Patent
Schmitt et al.

(10) Patent No.: US 6,550,064 B2
(45) Date of Patent: Apr. 22, 2003

(54) EAR SHIELD APPARATUS

(76) Inventors: Robert Schmitt, 7080 Lillian Court, Stuart, FL (US) 34997; Richard Kinsey, 5136 Glen Echo Tri Par Estates, Sarasota, FL (US) 34234

( * ) Notice: Subject to any disclaimer, the term of this patent is extended or adjusted under 35 U.S.C. 154(b) by 39 days.

(21) Appl. No.: 10/053,949

(22) Filed: Jan. 24, 2002

(65) Prior Publication Data

US 2002/0104152 A1 Aug. 8, 2002

Related U.S. Application Data

(60) Provisional application No. 60/261,861, filed on Jan. 17, 2001.

(51) Int. Cl.[7] ..... A61F 9/00

(52) U.S. Cl. ..... 2/10; 2/195.1; 2/209; 2/209.13

(58) Field of Search ..... 2/1, 455, 410, 2/6.2–6.5, 422, 423, 425, 10, 12, 449, 454, 451, 172, 208, 209, 209.12, 175.1, 175.6, 195.1; 128/864, 866

(56) References Cited

U.S. PATENT DOCUMENTS 3,430,261 A * 3/1969 Benner ..... 2/209
D282,308 S * 1/1986 Kain ..... D2/866
4,872,219 A * 10/1989 Duncan ..... 128/866
D327,339 S * 6/1992 Rasmussen et al. ..... D2/501
5,426,790 A * 6/1995 Robertson ..... 2/209
5,493,733 A * 2/1996 Pospisil ..... 2/195.1
5,615,417 A * 4/1997 Jackson ..... 2/209
5,778,455 A * 7/1998 Joseph ..... 2/174
6,237,147 B1 * 5/2001 Brockman ..... 2/10

* cited by examiner

*Primary Examiner*—Gary L. Welch
(74) *Attorney, Agent, or Firm*—Kevin Redmond

(57) ABSTRACT

An ear shield assembly which attaches to various headgear and protects the users ears against the sun and ultra violet rays, thereby reducing the probability of inducing cancer in this normally sensitive and exposed area. The head gear is typically a cap with the protective ear shield attachments positioned on opposite sides of the cap. These ear shields are placed above the ears and may be folded up against the cap and secured to the side of the cap with hood and loop material when they are not in use. When in use, these shields are lowered and extended outward horizontally from the brim of the cap, allowing air to reach the users ears, while at the same time blocking the sunlight from reaching the ears.

9 Claims, 3 Drawing Sheets

EAR SHIELD APPARATUS

This application claims the benefit of Ser. No. 60/261,861, filed Jan. 17, 2001.

BACKGROUND

1. Field

The present invention relates to ear shield and more particularly to shields designed to protect the ears from the sun.

2. Prior Art

There are a variety of prior art inventions that provide ear shields as illustrated by the following patents.

U.S. Pat. No. D282,308 illustrates a combined eye and ear shade. This invention comprises a visor with a brim extending outward over the users eyes and two ear pieces on either side of the visor. However, this visor does not have an upper portion protecting the top of the users ear and the ear pieces hang below the lower portion of the visor and are permanently positioned. They cannot be folded when not in use.

U.S. Pat. No. D327,339 illustrated a face and ear protector. This head gear uses net-like material to cover the lower portion of the face and ears and has a top piece that covers the top of the users head. However, this face and ear protector does not use fold away flaps to cover the ears. Instead it covers the nose and mouth of the user, making it generally uncomfortable and not practical for most sports including golf.

U.S. Pat. No. 4,872,219 illustrates a self supporting ear protector. It includes a unitary flexible core member formed from a flat elongated rectangular sheet of resilient, flexible plastic material substantially impervious to cold weather conditions, the sheet being molded and cut to form a ring shape of substantially constant thickness having the general configuration of the ear to be protected. However, it is made of the thick material and is not supported by a hinge. This invention protects the users ear from cold weather. It does not protect the ear from the sun.

U.S. Pat. No. 5,426,790 illustrates an apparatus for protecting a person's ears from the damaging ultra violet rays of the sun. The protective gear apparatus is positioned along the headband of the cap in accordance with the anatomical configuration of a persons head. However, the ear piece is inconvenient and cannot be moved to a storage position.

U.S. Pat. No. 5,778,455 illustrates an ear cover for protecting the external part of the ear. The cover includes a first flexible sheet having an outer layer formed of an absorbent material and an inner layer coextensive therewith formed of impermeable material. A second flexible sheet is secured to the first flexible sheet adjacent the inner layer to serve as a liner for the cover. An elastic band is secured between the first and second flexible sheets for gathering the respective peripheries thereof around the ear of the wearer. However, this invention is self supporting on the ear itself and is not attached to any kind of cap or hat. The ear piece had elastic to secure the cover to the ear. It is in effect an ear muff which would be uncomfortable for use in warm weather and it cannot be quickly and conveniently stored.

There are various types of ear protecting systems as shown in the above patents, but all have one or more short comings. For example, one does use flaps, but the flaps are not conveniently stored. Another is not designed for use in the sun. There is a need for a ear shield that is designed for use in the sun, and can be easily folded out of the way when not in use.

SUMMARY

Figure 1:
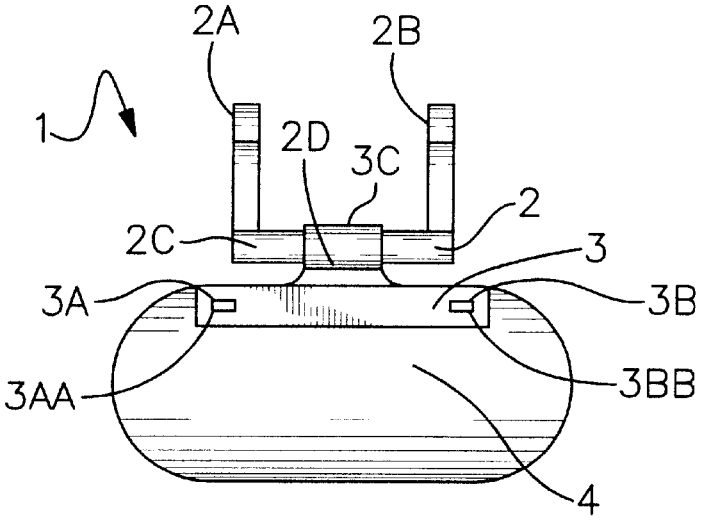
FIG. 1 is a bottom view of the shield assembly with the clips, which are used to grasp the brim of a cap, extending in the plane of the shield.

It is an object of the present invention to provide ear shields that fold out for use and fold away when not in use and which can be set at a desired angle above the ears.

It is an object of the present invention to provide ear shields that are supported by a cap, hat, sun visor or other conventional head gear.

It is an object of the present invention to provide ear shields that are small, light, easily stored and easily transported.

It is an object of the present invention to provide ear shields that provide clearance above the ears for cooling air flow, while at the same time shielding the ears from the sun.

The present invention provides an assembly that conveniently attaches to head gear to protect the users ears against the sun and ultra violet rays, thereby reducing the possibility of inducing cancer in this normally sensitive exposed area. The shields are manufactured from material which will attenuate or completely stop the suns penetration. Suitable materials range from plastic that is "smoked" or partially translucent similar to the lens in sunglasses to plastic or metal that is completely opaque. The head gear typically comprises a cap with the protective ear assembly attached and positioned on opposite sides of the cap. These ear shields are placed above the ears and may be folded up against the cap and secured to the side of the cap with hook and loop material when they are not in use. These shields, when in use, are lowered and extend outward horizontally from the brim of the cap, allowing air to reach the users ears, while at the same time blocking the sunlight from reaching the ears.

The complete protective assembly clips to the side of the cap and folds out over the ears when desired. This assembly is formed of a shield which is attached to a clip that grip the brim of a cap for support over the ears. The connection between the shields and the clips is a hinge mechanism made up of a shield bracket and a clip cross member. Within the clip cross member is a hexagonal rod which is gripped by a socket in the shield bracket. The shield is permitted to fold up or down by rotating of the shield about the hexagonal rod. The hexagonal rod is the heart of the hinge mechanism. The rotation of the hinge mechanism can be stopped at any one of the flats on the hexagonal rod to provide as much or as little coverage of the ear as desired.

DETAILED DESCRIPTION OF THE INVENTION

To clarify the terms used in this description of the invention, the following definitions are provided. A "clip"

refers generally to a device having two arms with the arms biased to close on one another to grip material between the two arms. At least one of the arms is articulated or flexible while the other may be fixed, or both of the arms are either flexible or articulated to enable them to close on one another. A "sun shield" is typically comprised of sheet material that attenuates the suns radiation and is positioned to shield the sun from the ear without touching the ear, thereby allowing air to flow about the ear. A rod, in a first embodiment, is an element that may take the form of a cylinder having a central longitudinal axis. In a second embodiment, the rod may contain flats along its peripheral surface running generally parallel to the longitudinal axis of the rod. An example of the second embodiment is an element having a hexagonal cross section. The ends of the rod that exhibit the hexagonal cross section are not considered flats. A socket cavity is a cavity that is typically sufficiently long in depth to accept and hold in a close fit a substantial portion of a rod, such as 25 percent of a rod length. The word "flexible" when applied to a cavity refers to the ability of the cavity to expand sufficiently to loosen a close fit about a rod and allow the rod to be turned in the cavity.

Figure 5:
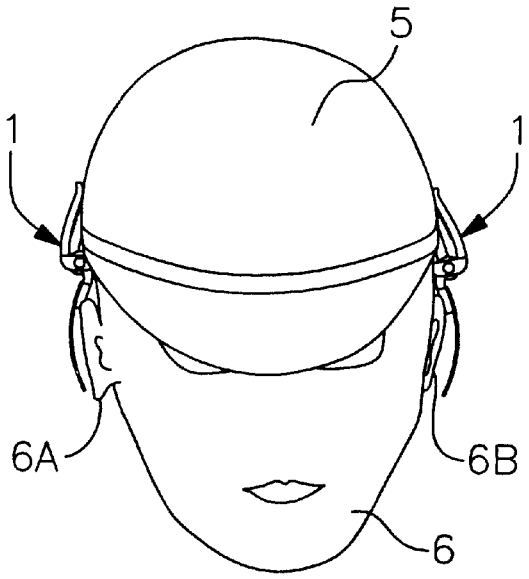
FIG. 5 shows an individual using the shield.

The present invention is an assembly designed to protect the ears from the sun. FIG. 5 shows an individual 6 wearing a cap 5, with this assembly 1 clipped to the cap and positioned over the left ear 6A and over the right ear 6B. This assembly can be used for either ear, as it is symmetrical in shape and designed to clip to either side of a cap.

FIG. 1 is a bottom view of the entire unit and its associated clip assembly. The clip assembly 2 is formed of two clips 2A and 2B, a cross member 2C and shield bracket 3. The shield 4 is attached to the shield bracket 3. In this Figure, it can be seen that clip 2A is located to the left and clip 2B is located to the right. The clips are attached to opposite ends of the cross member. Two clips are used because they securely hold the assembly to the cap and prevent it from rotating in an undesired mode, which is in a vertical plane that is parallel to the side of the users face.

Figure 2:
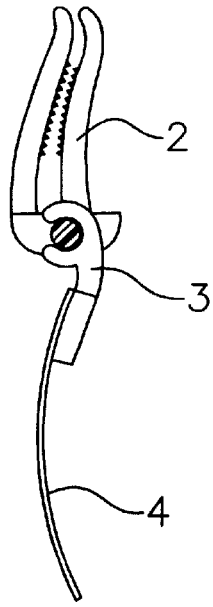
FIG. 2 is a side sectional view of the shield assembly with the clip extended in the plane of the shield.

FIG. 2 is a side view of the assembly shown in FIG. 1. It contains the clip 2A, shield bracket 3 and the shield. The shield bracket has a first end and a second end. The first end contains a socket cavity 3C, while the second end contains holes 3AA and 3BB. The shield is attached to the shield bracket by means of two projections 3A and 3B in the shield bracket which extends through holes 3AA and 3BB respectively in the shield directly beneath where the projections 3A and 3B are shown in FIG. 1.

Figure 7:
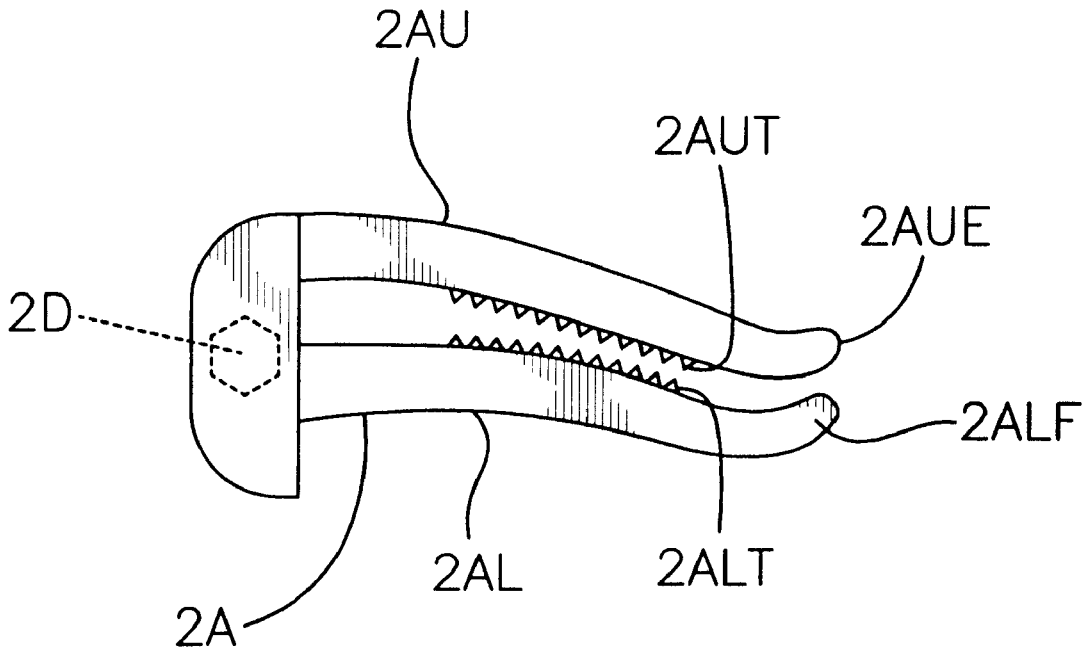
FIG. 7 is an enlarged, side view of a clip.

FIG. 7 is an enlarged side view of the clip 2A showing the clip to have a first end with two arms 2AU and 2AL, and a second end with a hexagonal rod 2D embedding in the clip. The rod is shown in an end view in this Figure. The rod has a central axis which extends vertically upward from the surface of the clip in this view. The inside surfaces of the arms 2AU and 2AL, face each other and contain teeth. The upper arm 2AU has teeth 2AUT on its lower side while the lower arm 2AL has teeth 2ALT on its upper side. These teeth are designed to secure the clip to the cap. The tip of the upper arm is designated as 2AUE, while the tip of the lower arm is designated as 2ALF. These tips cure upwards. The tips point toward the users head when the clip is attached to the cap.

Figure 3:
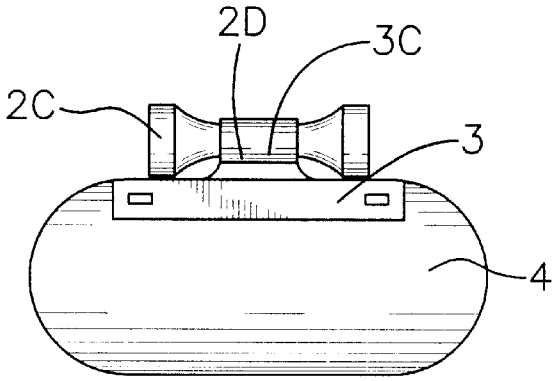
FIG. 3 is a bottom view of the shield assembly with the clip extended orthogonal to the plane of the shield, which is the in-use position for the invention.
Figure 4:
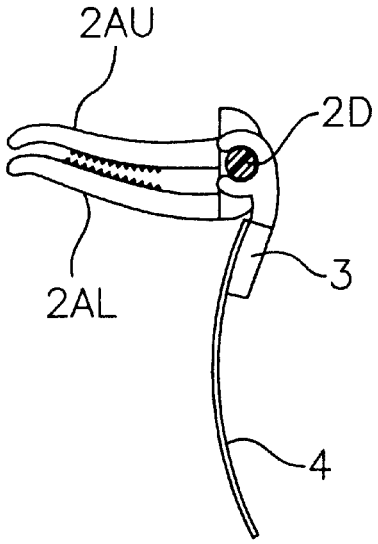
FIG. 4 is a side sectional view of the shield assembly with the clips extended orthogonal to the plane of the shield.

FIG. 3 is bottom view of the shield assembly with the clip extended orthogonal to the plane of the shield. FIG. 4 is side sectional view of the shield assembly with the clip extending orthogonal to the plane of the shield. When the clip is extended orthogonal to the plane of the shield, it is in the position in which it is used when clipped to the hat. The clip slides up about the brim and the shield extends orthogonally from the side of the head as shown in FIG. 5.

Figure 6:
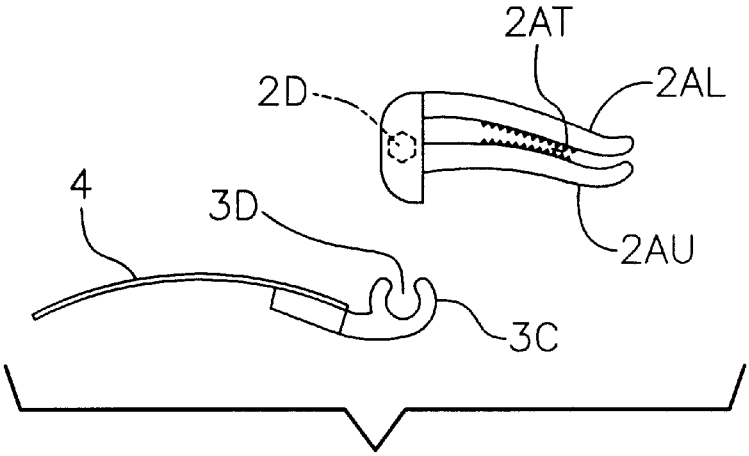
FIG. 6 is a side sectional view of the shield holder and clip prior to the engagement of these two components.

FIG. 6 is a side elevation view of the bracket and clip prior to engagement. It is the hexagonal rod 2D, which is gripped by a socket cavity 3C in the shield bracket. This cavity is part of a first port in the bracket. It has a central axis that is colocated with the central axis of the rod when the rod is placed into the first port. The opening to the first port is referred to as the first opening to the cavity socket 3C. In this Figure, teeth in general on the upper and lower arms are collectively designated by drawing numerical 2AT. FIG. 7 shows an enlarged side elevation view of the clip and hexagonal rod 2D. The hexagonal rod can be rotated in the socket 3C and comes to rest at each flat on the hexagonal rod, allowing the shield to be held at several different positions over the ears. It is evident that a rod other than a hexagonal rod, such as a octagonal rod, can be used. The rod can vary from a single flat rod to a multi-flat rod.

There are many possible equivalent embodiments of the hinge mechanism formed by the socket cavity and the rod. In one embodiment there are no flats. The socket simply clamps the rod in place. In a second embodiment only the rod has flats. The sides of the socket cavity are flexible. As the rod is turned, the sides of the cavity expand allowing the points between the flats to pass. Once the turning is stopped, a tight fit between the cavity and the rod causes the cavity to hold the rod from turning further, unless an external force is again applied. The rod is essentially clamped or locked in place, locking the shield in place at a desired angle over the ear.

In a third embodiment, the cavity has a second port and a corresponding second opening to admit the rod. This opening 3D is shown in FIG. 6. It facilitates the movement of the sides of the cavity as the rod with it flats is turned in the cavity. The second opening is generally in a plane that is orthogonal to the first opening. However, it is clear that the first or second opening need not necessarily be orthogonal for the second opening to function; although orthogonal locations of the first and second opening are the most obvious and aid in describing the relationship between these openings. An opening for the second port on a place at virtually any angle to first opening would serve to allow the sides of the socket cavity to expand more easily as the rod is turned. All such location of the first and second openings are considered equivalent.

Figure 8:
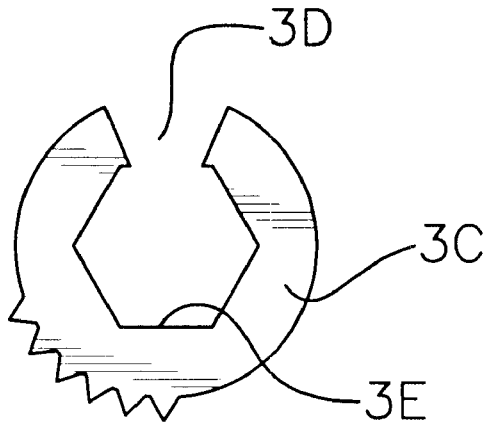
FIG. 8 is a partial side view of a socket in the clip which has flats to engage flats on a hexagonal rod and secure the shield in a selected position.

In a fourth embodiment shown in FIG. 8, the inside of the cavity has flats 3E to match those of the rod, providing multiple surfaces on which the multiple flats of the rod can rest to provide an improved locking systems for the rod. The separation of the shield from the ears allows air to flow over the ears to provide cooling, while at the same time blocking the sun's rays from reaching the ears. The ability of the shield to rotate or fold with respect to the clip aids in placing the shield up along side the cap when not in use and it also aids in folding the clip up along side the shield to provide a compact package for storage or transportation.

Having described my invention, I claim the objective found in the summary section above.

Having described our invention, we claim:

1. An ear protection assembly designed to be clipped to head gear to protect the ears from the sun, comprising:

(a) an ear shield made of sheet material which attenuates the suns radiation, said shield having a first side of a plurality of sides formed along the edge of said sheet material and said sheet material being positioned between the sun and the ear to block said radiation from reaching the ear, (b) a bracket having a first and a second end, said bracket being attached to said first side of said shield at said first end of said bracket and said bracket having a socket cavity built into the second end of said bracket, (c) a clip assembly including a first clip, said first clip having a first and a second end, and said first clip having on its first end an upper and a lower arm that are spaced apart, each of said arms having an inside surface that faces the same surface on the opposite arm to enclose and grip said head gear to support said clip assembly on said head gear, and (d) a rod having an outside diameter which permits rotation of said rod within said socket cavity while still providing a close fit to said cavity to generate resistance to said rotation, said rod being positioned generally horizontally and parallel to the side of the wearers head about the ear to be protected, said rod being joined to said clip assembly to connect said clip assembly to said bracket and permit rotation of said shield through an arc of nominally 180 degrees through which said shield passes from flat up against the side of the head gear to horizontally outward from the side of the wearer's head about the ear to be protected to down and parallel to the ear to be protected, but not in contact with said ear.

2. An ear protection assembly as claimed in claim 1, wherein said socket contains a flat.

3. An ear protection assembly as claimed in claim 2 wherein said rod contains at least one flat.

4. An ear protection assembly as claimed in claim 3 wherein said rod contains multiple flats and said socket cavity contains a matching set of an equal number of flats to provide a positive lock on said rod when said rod comes to rest from rotation in said socket cavity, said lock being produced by way of all the flats on the rod resting all of the flats of the socket cavity.

5. An ear protection assembly in claim 1, wherein said socket is flexible allowing the socket cavity to expand while the rod is rotated by an external force in said socket cavity, said rod being held in position after being rotated by the pressure of the socket cavity on the rod and the close fit of the socket cavity about the rod.

6. An ear protection assembly as claimed in claim 5 wherein said socket cavity contains multiple flats to permit the flat on the rod to rest on any one of said multiple flats in said cavity and thereby permit locking said shield at various angles with respect to the ear.

7. An ear protection assembly as claimed in claim 1, wherein said first clip includes teeth on the inside surfaces of the upper and the lower arm to aid in gripping the head gear.

8. An assembly as claimed in claim 1 further including a second clip, which is generally similar to said first clip, said second clip having a first and a second end, said second clip being attached at its second end by means of a second rod to said bracket and said second clip being attached to said head gear at its first end, said first and second clips cooperating to prevent unintentional rotation of said assembly with respect to said head gear.

9. An assembly as claimed in claim 1, wherein said socket cavity contains a first and a second port, said first port accepting said rod and having a central axis collocated with axis of rotation of said rod, said first port providing a first opening into said bracket and said first opening being in a plane that is generally orthogonal to said central axis, said second port being in a plane generally orthogonal to said first port and said second port allowing for expansion of sides of said first port as said rod is rotated in said first port.

* * * * *